US008085240B2

(12) United States Patent
Matsuura

(10) Patent No.: US 8,085,240 B2
(45) Date of Patent: Dec. 27, 2011

(54) DISPLAY APPARATUS HAVING A DETECTION SIGNAL LINE USED TO TRANSMIT DRIVING VOLTAGE SIGNALS TO A DIGITAL DRIVER

(75) Inventor: Minoru Matsuura, Kanagawa (JP)

(73) Assignee: Sony Corporation, Tokyo (JP)

( * ) Notice: Subject to any disclaimer, the term of this patent is extended or adjusted under 35 U.S.C. 154(b) by 843 days.

(21) Appl. No.: 12/156,102

(22) Filed: May 29, 2008

(65) Prior Publication Data

US 2009/0002296 A1 Jan. 1, 2009

(30) Foreign Application Priority Data

Jun. 28, 2007 (JP) ..... P2007-171047

(51) Int. Cl.
*G09G 3/36* (2006.01)

(52) U.S. Cl. ..... 345/103; 345/88

(58) Field of Classification Search ..... 345/103, 345/88, 89, 87
See application file for complete search history.

(56) References Cited

U.S. PATENT DOCUMENTS

2001/0033260 A1* 10/2001 Nishitani et al. ..... 345/87
2006/0262064 A1* 11/2006 Matsuura ..... 345/98

FOREIGN PATENT DOCUMENTS

JP 2005-077745 3/2005

* cited by examiner

*Primary Examiner* — Chanh Nguyen
*Assistant Examiner* — Long Pham
(74) *Attorney, Agent, or Firm* — Robert J. Depke; Rockey, Depke & Lyons, LLC

(57) ABSTRACT

A display apparatus includes a DSD for outputting a digital video signal and a wiring board. The wiring board includes a first wiring portion in which signal lines used to transmit the digital video signal output from the DSD are disposed, a signal generation circuit for generating drive voltage signals, and a second wiring portion in which signal lines used to transmit the drive voltage signals to a panel substrate are disposed. In the first wiring portion, a detection signal line used to transmit the drive voltage signals to the DSD is disposed. In the signal generation circuit, an output wiring portion including output lines used to transmit the drive voltage signals to the signal lines in the second wiring portion and a detection line having one end connected to the detection signal line and the other end connected to the output lines via switches are disposed.

2 Claims, 8 Drawing Sheets

DISPLAY APPARATUS HAVING A DETECTION SIGNAL LINE USED TO TRANSMIT DRIVING VOLTAGE SIGNALS TO A DIGITAL DRIVER

CROSS REFERENCES TO RELATED APPLICATIONS

The present invention contains subject matter related to Japanese Patent Application JP 2007-171047 filed in the Japanese Patent Office on Jun. 28, 2007, the entire contents of which are incorporated herein by reference.

BACKGROUND OF THE INVENTION

1. Field of the Invention

The present invention relates to a display apparatus including a panel substrate having a display panel with x×y pixels arranged in a matrix at intersections of x (x is a natural number) signal lines disposed in a column direction and y (y is a natural number) gate lines disposed in a row direction.

2. Description of the Related Art

In active matrix display panels such as liquid crystal display panels, the number of pixels tends to increase with the increase in the degree of definition. With the increasing number of pixels, a so-called block sequential driving method has been used in which a panel driver for driving a display panel simultaneously applies drive voltages to pixel blocks each having a plurality of pixels continuously arranged in the scanning direction of the display panel.

In such a block sequential driving method, drive voltage signals to be transmitted to a plurality of pixels, for example, six, twelve, or twenty-four pixels included in each pixel block are transmitted to a display panel. Accordingly, there are several to several tens of signal lines between a signal generation circuit for generating the drive voltage signal and a panel driver.

However, if a high-resolution image such as a Full HD image (image size: 1920×1080), a 2K1K image (image size: 2048×1024), or a 4K2K image (image size: 4096×2048) is displayed on a display panel using the above-described block sequential driving method, it is required to operate a panel driver at a high speed so as to ensure sufficient time to transmit drive voltage signals to all pixels included in one frame in synchronization with a frame rate.

As a technique for rapidly transmitting drive voltage signals to all pixels included in one frame, Japanese Unexamined Patent Application Publication No. 2005-77745 discloses a driving apparatus for driving a display panel using a so-called pseudo line sequential driving method in which desired signal lines are sequentially selected one by one for sampling of a video signal from each of a plurality of signal line groups, which are obtained by dividing signal lines included in the display panel into the signal line groups, so that the sequential selection of the signal lines is simultaneously performed in the signal line groups. For example, if a single signal line group includes six signal lines and a Full HD image is displayed, drive voltage signals for 320 pixels are required to be simultaneously transmitted from a panel driver to pixels arranged on a display panel. In the above-described pseudo line sequential driving method, the number of signal lines between a signal generation circuit for generating the drive voltage signal and the panel driver can be increased to several hundreds of signal lines. As a result, it is possible to ensure sufficient time to transmit drive voltage signals to all pixels included in one frame.

A display apparatus in which a display panel is driven using the pseudo line sequential driving method includes, for example, a DSD (Digital Signal Driver) for performing pieces of signal processing such as gamma correction, color unevenness correction, and data sorting, a signal generation circuit for generating a drive voltage signal in accordance with pixel data output from the DSD and a pulse signal used to control the drive timing of a display panel, and the display panel that is driven in response to a signal generated by the signal generation circuit.

In such a display apparatus, drive voltage signals for 320 pixels are simultaneously transmitted to a display panel. Accordingly, for example, the DSD and the display panel are connected to each other at an FPC (Flexible Print Circuit) board, and the signal generation circuit is provided on the FPC board using a COP (Chip On FPC) method. The reason for this is that if a driver including the signal generation circuit is externally attached to the FPC board, a large number of drivers and several hundreds of output terminals of the DSD are required. This leads to upsizing of a display apparatus and an increase in system cost.

SUMMARY OF THE INVENTION

In a display apparatus, there is an output deviation among drive voltage signals output from a signal generation circuit. Under the influence of the output deviation, the luminance levels of pixels on a display panel also vary. This leads to degradation in image quality. In order to analyze and correct the influence of the output deviation, it is required to detect the drive voltage signals output from output terminals of the signal generation circuit.

However, the output terminals of a signal generation circuit mounted on a printed wiring board using the COF method are individually connected to signal lines on the printed wiring board. Accordingly, it is very difficult to form a signal line for detection of a drive voltage signal on the printed wiring board.

It is desirable to provide a display apparatus that includes, on a wiring board on which a plurality of signal lines are provided in parallel with each other, a signal generation circuit for generating drive voltage signals used to drive pixels arranged on a display panel and that is capable of detecting an output deviation among the drive voltage signals output from the signal generation circuit.

A display apparatus according to an embodiment of the present invention includes a panel substrate on which a display panel and a signal line selection unit are disposed. The display panel has x×y pixels arranged in a matrix at intersections of x (x is a natural number) signal lines disposed in a column direction and y (y is a natural number) gate lines disposed in a row direction. The signal line selection unit sequentially selects k signal lines included in each of x/k signal line groups obtained by dividing the x signal lines into the x/k signal line groups each including the k signal lines that are adjacent to each other without overlapping each other so that the sequential selection of the k signal lines is simultaneously performed in the x/k signal line groups and supplies drive voltage signals to a total of x/k selected signal lines. The display apparatus includes: an input unit configured to receive a digital video signal composed of pieces of pixel data arranged in a predetermined scanning direction; a digital signal processing section including a data arrangement conversion unit configured to convert the digital video signal received by the input unit into a total of x/k pixel data strings by sequentially selecting k pieces of pixel data included in each of a total of x/k pixel data groups obtained by dividing x pieces of pixel data arranged in the same column direction into the x/k pixel data groups each including the k pieces of pixel data that are adjacent to each other without overlapping each other, and an output unit configured to output digital video signals corresponding to the pixel data strings converted by the data arrangement conversion unit as a total of p-phase (p is a natural number satisfying $p<(x/k)$) pieces of digital data; and a wiring board including a first wiring portion in which p signal lines used to transmit a digital video signal composed of the p-phase pieces of digital data output from the digital signal processing section are disposed in parallel with each other, a signal generation circuit for generating x/k-phase drive voltage signals from the digital video signal transmitted from the first wiring portion, and a second wiring portion in which x/k signal lines used to transmit the x/k-phase drive voltage signals generated by the signal generation circuit to the signal line selection unit disposed on the display panel are disposed in parallel with each other.

In a display apparatus according to an embodiment of the present invention, on a wiring board, a detection signal line used to transmit a drive voltage signal generated by a signal generation circuit to a digital signal processing section as a detection signal is disposed in a first wiring portion. A detection line having one end connected to the detection signal line and the other end connected via switches to any output lines for outputting the drive voltage signal is disposed in the signal generation circuit. Accordingly, an output deviation among drive voltage signals output from the output lines in the signal generation circuit, which are individually connected to signal lines in a second wiring portion, can be detected.

DESCRIPTION OF THE PREFERRED EMBODIMENTS

A display apparatus according to an embodiment of the present invention includes a panel substrate having a display panel with x×y pixels arranged in a matrix at intersections of x (x is a natural number) signal lines disposed in a column direction and y (y is a natural number) gate lines disposed in a row direction. The description of an embodiment of the present invention will be made below using a liquid crystal display apparatus as an example of the above-described display apparatus. The liquid crystal display apparatus includes a panel substrate and a liquid crystal display panel formed on the panel substrate. The liquid crystal display panel is obtained by disposing two electrode substrates, at least one of which is a transparent substrate, opposite to each other and sandwiching a liquid crystal therebetween, and performs modulation of incident light upon receiving a drive voltage signal through the liquid crystal.

Figure 1:
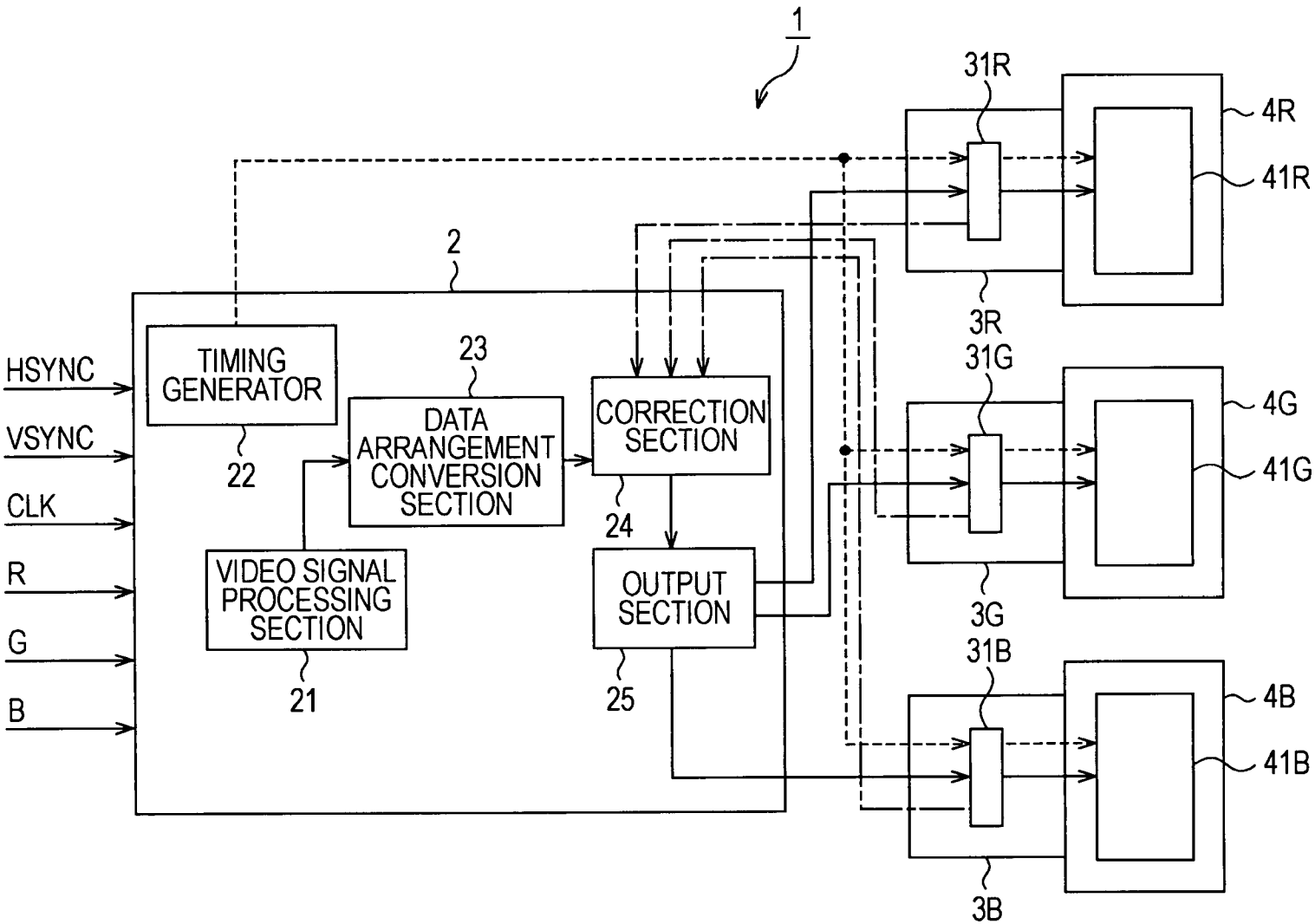
FIG. 1 is a schematic diagram illustrating a configuration of a liquid crystal display apparatus.

FIG. 1 is a schematic diagram illustrating a configuration of a liquid crystal display apparatus 1.

The liquid crystal display apparatus 1 includes a panel substrate 4R with a display panel 41R for red, a panel substrate 4G with a display panel 41G for green, and a panel substrate 4B with a display panel 41B for blue. These display panels are liquid crystal display panels installed in, for example, a three-plate liquid crystal projector.

Furthermore, the liquid crystal display apparatus 1 includes a DSD (Digital Signal Driver) 2 for performing predetermined digital signal processing upon an externally supplied digital video signal, a wiring board 3R with a signal generation circuit 31R for driving the display panel 41R, a wiring board 3G with a signal generation circuit 31G for driving the display panel 41G, and a wiring board 3B with a signal generation circuit 31B for driving the display panel 41B.

In the liquid crystal display apparatus 1 having the above-described configuration, the configurations of the panel substrates 4R, 4G, and 4B are the same except that the output wavelength ranges of a video signal thereof are different from each other. Accordingly, in the following, description will be made by taking the panel substrate 4R and the wiring board 3R connected to the panel substrate 4R as an example.

Figure 2:
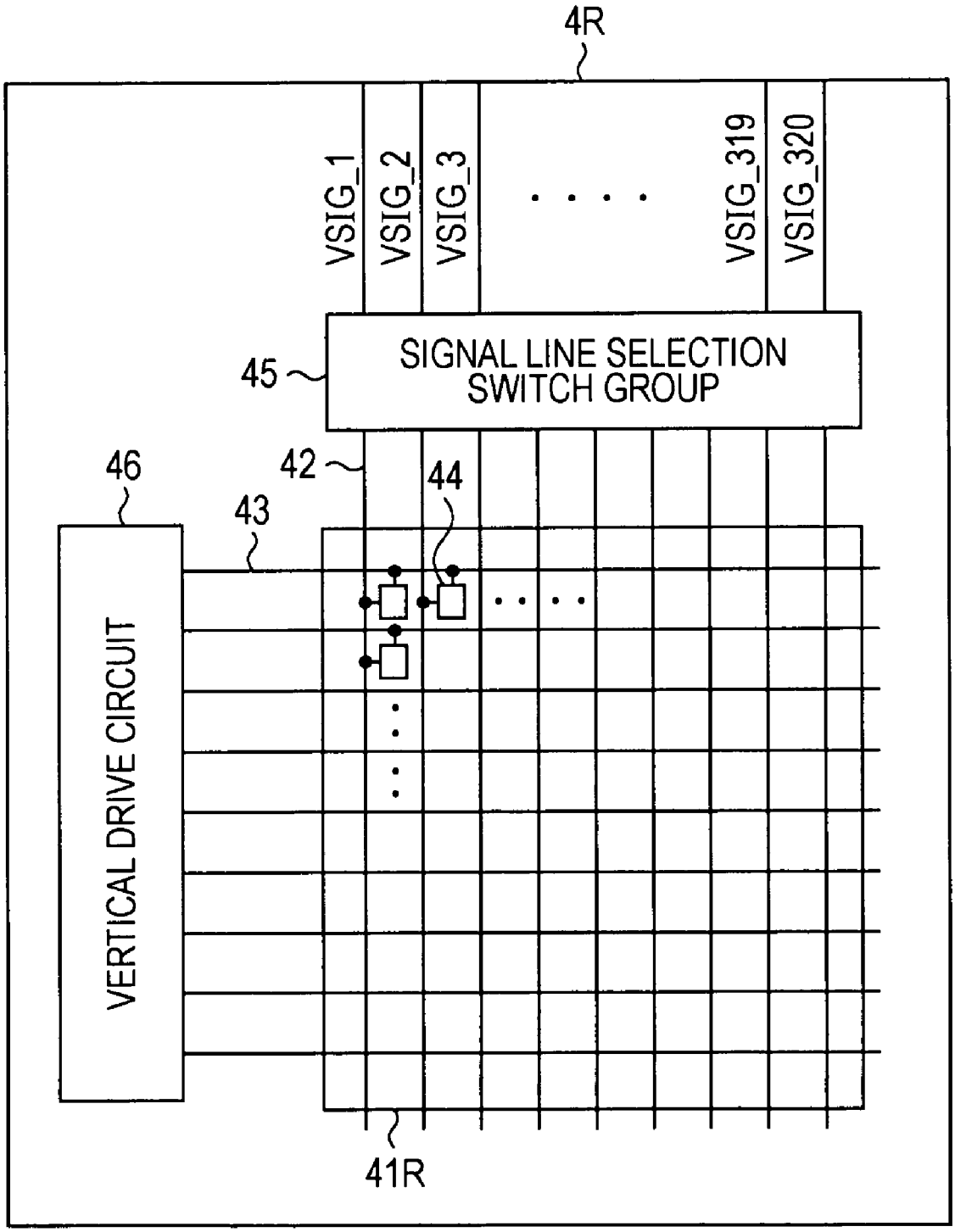
FIG. 2 is a schematic diagram illustrating a configuration of a panel substrate.

As illustrated in FIG. 2, the panel substrate 4R is provided with the display panel 41R including the x×y pixels 44 arranged in a matrix at intersections of the x signal lines 42 disposed in a column direction and the y gate lines 43 disposed in a row direction.

In the following, description will be made by taking a liquid crystal display panel for outputting a FULL HD picture in which the 1920×1080 pixels 44 are arranged at intersections of the 1920 signal lines 42 disposed in a column direction and the 1080 gate lines 43 disposed in a row direction as a concrete example of the display panel 41R having the above-described configuration.

The panel substrate 4R is provided with a signal line selection switch group 45 connected to the signal lines 42 and a vertical drive circuit 46 connected to the gate lines 43 so as to drive the display panel 41R.

The pixels 44 each includes a TFT (Thin Film Transistor) (not illustrated) and a liquid crystal cell (not illustrated). The gate electrode of the TFT is connected to a corresponding one of the gate lines 43, the source electrode thereof is connected to a corresponding one of the signal lines 42, and the drain electrode thereof is connected to one of electrodes (pixel electrode) of the liquid crystal cell.

The signal line selection switch group 45 includes a plurality of switches used to transmit a drive voltage signal transmitted from the wiring board 3R, which will be described later, to the signal lines 42.

The vertical drive circuit 46 is connected to the gate lines 43 so as to sequentially select the gate lines 43.

In the panel substrate 4R having the above-described configuration, drive voltage signals are sequentially transmitted to the pixels 44 using a so-called pseudo line sequential driving method. Accordingly, the signal line selection switch group 45 sequentially selects the k signal lines 42 included in each of x/k signal line groups, which are obtained by dividing the x signal lines 42 into the x/k signal line groups each having the k signal lines 42 that are adjacent to each other without overlapping each other, so that the sequential selection of the k signal lines 42 is simultaneously performed in the x/k signal line groups.

Figure 3:
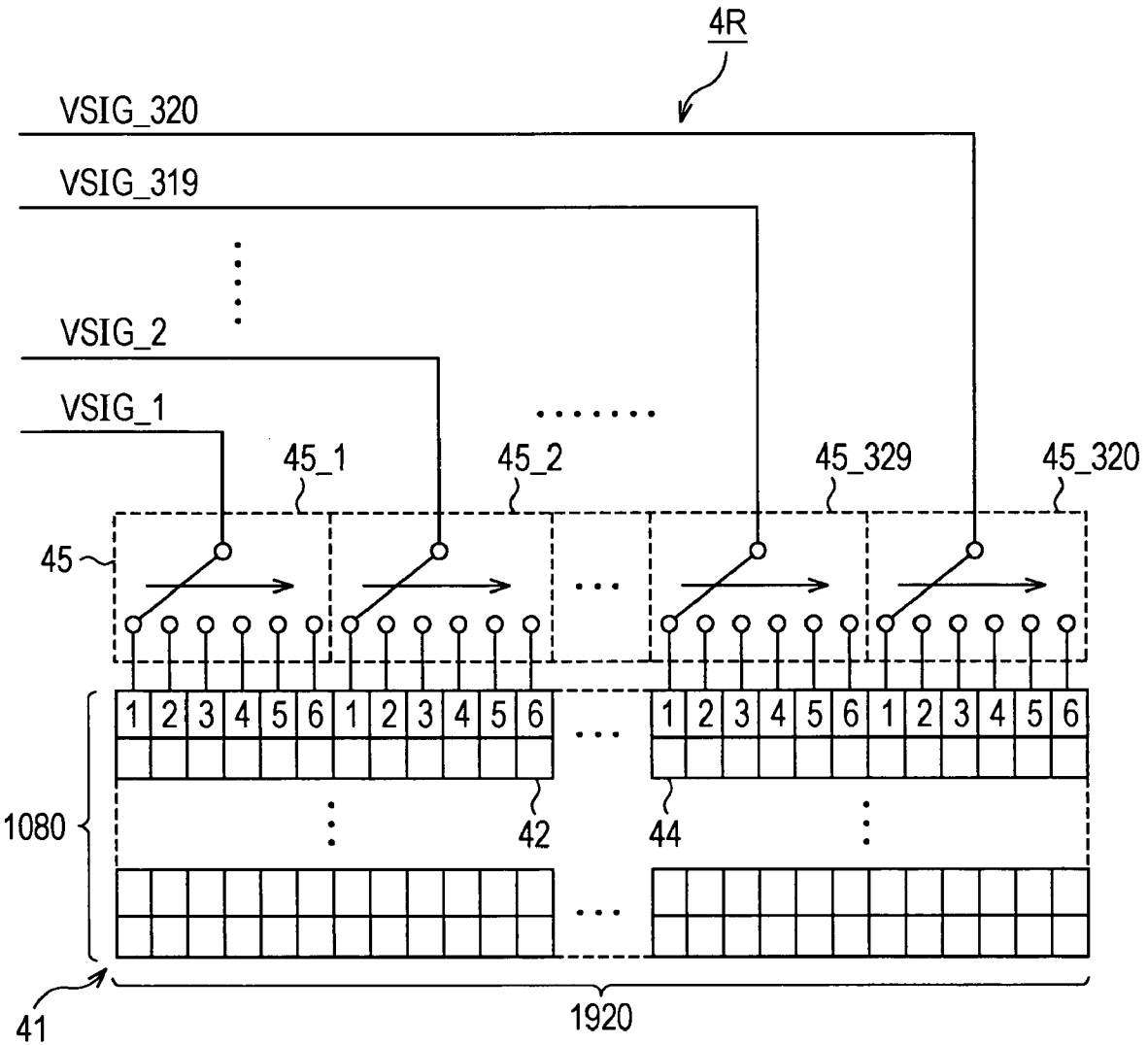
FIG. 3 is a diagram describing a driving method of a display panel.

For example, as illustrated in FIG. 3, the signal line selection switch group 45 includes 320 signal line switches 45_1 to 45_320 for 320 signal line groups obtained by dividing the 1920 signal lines 42 into the signal line groups each including six signal lines that are adjacent to each other without overlapping each other.

Each of the signal line switches 45_1 to 45_320 sequentially selects signal lines one by one in a scanning direction so that the signal line switches 45_1 to 45_320 simultaneously perform the sequential selection of signal lines, and supplies a drive voltage signal transmitted from the wiring board to the selected signal line 42.

Next, the configuration of the DSD 2 will be described.

The DSD 2 includes a video signal processing section 21 for performing predetermined video signal processing upon a digital video signal, a timing generator 22 for generating a timing pulse used to control the operation of each of the panel substrates 4R, 4G, and 4B, a data arrangement conversion section 23 for converting arrangement of pieces of pixel data included in a digital video signal, a correction section 24 for correcting the digital video signal, and an output section 25 for outputting the digital video signal to the wiring board 3R.

The video signal processing section 21 performs gamma correction and color unevenness correction upon each of externally supplied R, G, and B digital video signals, and supplies the processed digital video signal to the data arrangement conversion section 23.

The timing generator 22 generates a timing pulse used to synchronize the operations of the signal generation circuits 31R, 31G, and 31B on the basis of a reference clock signal CLK, a horizontal synchronizing signal HSYNC, and a vertical synchronizing signal VSYNC which are externally supplied, and supplies the generated timing pulse to each of the signal generation circuits 31R, 31G, and 31B. Furthermore, the timing generator 22 generates a timing pulse used to synchronize the operations of the display panels 41R, 41G, and 41B, and supplies the generated timing pulse to each of the display panels 41R, 41G, and 41B.

The data arrangement conversion section 23 converts the arrangement of pieces of pixel data included in a digital video signal supplied from the video signal processing section 21 on the basis of the above-described driving method of the display panel 41R, that is, the pseudo line sequential driving method, in the following manner. That is, the data arrangement conversion section 23 converts the digital video signal into a total of x/k (320) pixel data strings by dividing the x (1920) pieces of pixel data arranged in the same direction into a total of x/k (320) pixel data groups each including k (six) pieces of pixel data that are adjacent to each other without overlapping each other and sequentially selecting the k (six) pieces of pixel data included in each of the x/k (320) pixel data groups. The data arrangement conversion section 23 supplies a digital video signal for each of the converted pixel data strings to the correction section 24.

The correction section 24 corrects pieces of pixel data included in the digital video signal supplied from the video signal processing section 21 through the data arrangement conversion section 23 in response to a detection signal supplied from the signal generation circuit 31R which will be described later, and supplies the corrected digital video signal for each of the pixel data strings to the output section 25.

The output section 25 receives the digital video signals, each of which is for one of the pixel data strings, from the correction section 24 and outputs the received digital video signals as a total of p-phase (p is a natural number satisfying $p<(x/k)$) pieces of digital data D_1 to D_10. For example, the output section 25 sets the natural number p satisfying the above-described condition to 10, and outputs a digital video signal composed of a total of 10-phase pieces of digital data to the wiring board 3R. Here, 320 pieces of pixel data are required for generation of 320-phase drive voltage signals. However, instead of the 320 pieces of pixel data, the output section 25 outputs the digital video signal composed of the 10-phase pieces of digital data to the wiring board 3R so as to reduce the number of output terminals used for output of digital data.

The wiring board 3R to which the digital video signal is supplied from the DSD 2 is an FPC (Flexible Print Circuit) board on which a plurality of signal lines are arranged in parallel with each other. On the wiring board 3R, the signal generation circuit 31R is disposed using the COP (Chip On FPC) method. The signal generation circuit 31R generates x/k-phase (320-phase) drive voltage signals VSIG_1 to VSIG_320 from the digital video signal composed of the p-phase (10-phase) pieces of digital data D_1 to D_10 output from the DSD 2. The 320-phase drive voltage signals VSIG_1 to VSIG_320 are transmitted to the panel substrate 4R via the signal lines arranged on the wiring board 3R.

Figure 4A:
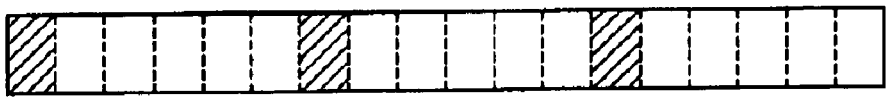
FIGS. 4A and 4F are diagrams describing a driving method of a display panel.
Figure 4B:
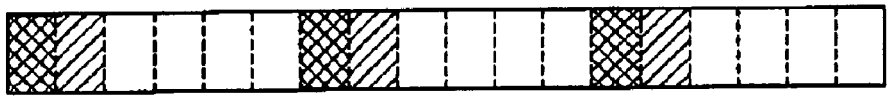
Figure 4C:
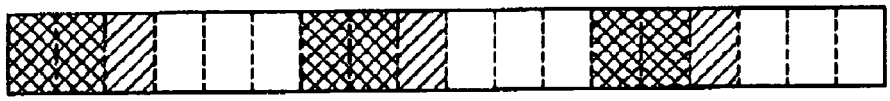
Figure 4D:
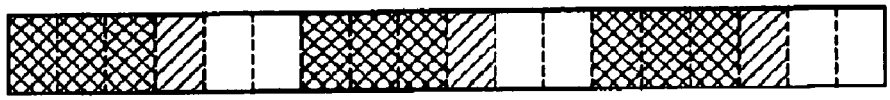
Figure 4E:
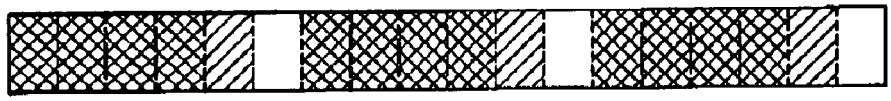
Figure 4F:
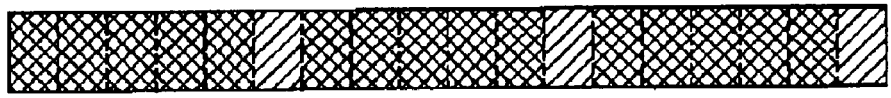

In the liquid crystal display apparatus 1 having the above-described configuration, first, as illustrated in FIG. 4A, a drive voltage signal is supplied to pixels arranged at intervals of five pixels from a pixel of the left end. Subsequently, as illustrated in FIGS. 4B, 4C, 4D, 4E, and 4F, a drive voltage signal is supplied to next pixels on the right side of the preceding pixels.

Thus, in the liquid crystal display apparatus 1, as compared with the block sequential driving method, the number of pixels capable of being updated at a time is markedly increased. For example, 320 pixels can be updated at a time. Accordingly, it is possible to ensure sufficient time to supply drive voltage signals to all pixels included in one frame. That is, in the liquid crystal display apparatus 1, for example, a drive voltage applied to 320 pixels among the pixels 44 arranged in a matrix on the display panel 41R at a time can be updated.

In order to achieve the above-described driving of the display panel 41R, as described previously, the signal generation circuit 31R disposed on the wiring board 3R is required to simultaneously output 320-phase drive voltage signals. In the signal generation circuit 31R, an output deviation among the drive voltage signals VSIG_1 to VSIG_320 occurs. Under the influence of the output deviation, variations among the luminance levels of the pixels 44 on the display panel 41R occur. This leads to degradation in image quality.

However, since output terminals of the signal generation circuit 31R disposed on the wiring board 3R are individually connected to signal lines on the wiring board 3R, it is difficult to dispose a line for detection of a drive voltage signal on the wiring board 3R.

Next, the configuration and operation of the liquid crystal display apparatus 1 capable of detecting a drive voltage signal output from the signal generation circuit 31R disposed on the wiring board 3R will be described below.

Figure 5:
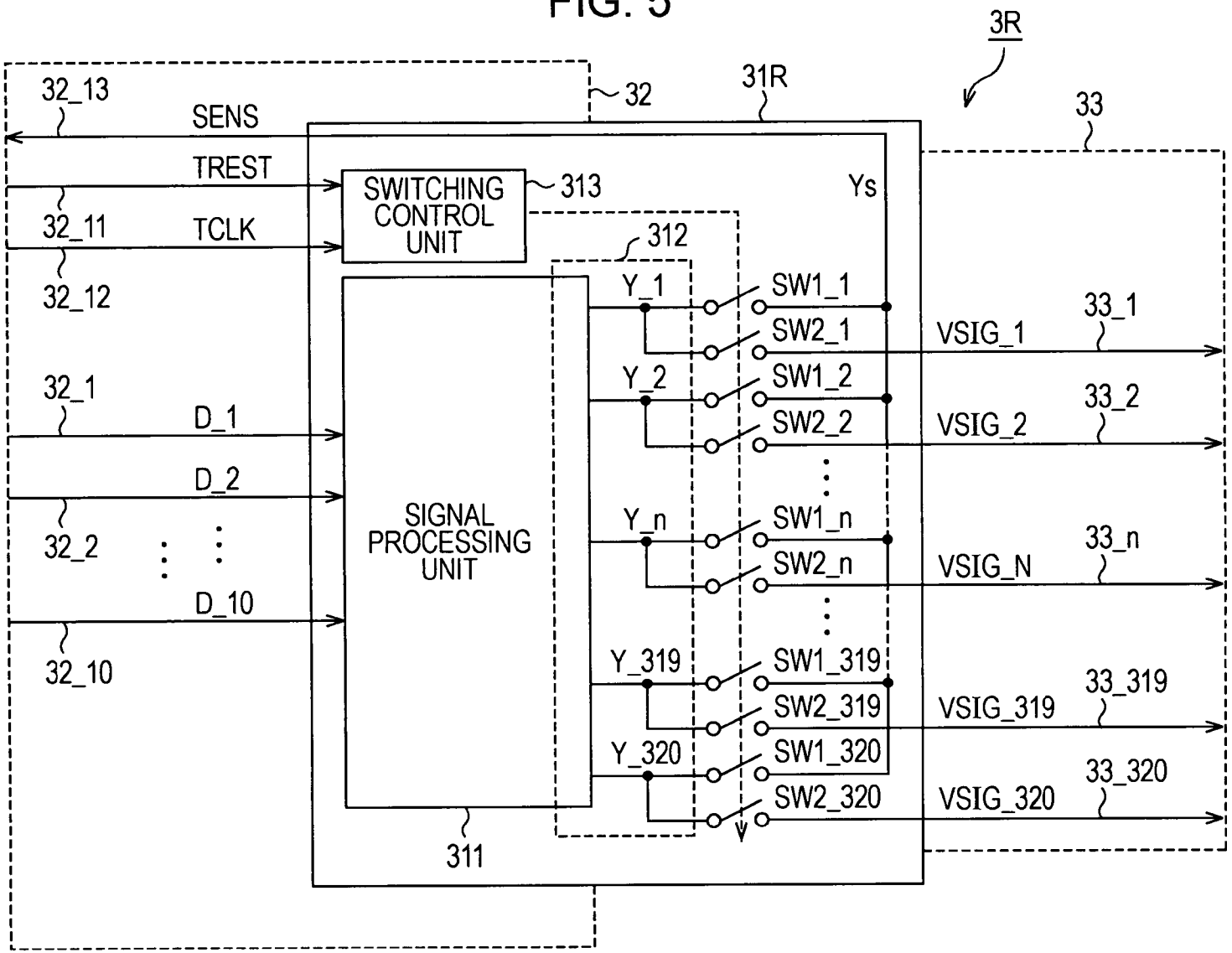
FIG. 5 is a schematic diagram illustrating a configuration of a wiring board.

FIG. 5 is a schematic diagram illustrating a wiring configuration of the wiring board 3R. At the wiring board 3R, a first wiring portion 32 and a second wiring portion 33 are disposed for connection to the signal generation circuit 31R.

In the first wiring portion 32, p (ten) signal lines 32_1 to 32_10 used to transmit the p-phase (10-phase) pieces of digital data D_1 to D_10 to the signal generation circuit 31R are arranged in parallel with each other.

Furthermore, in the first wiring portion 32, a signal line 32_11 for transmitting a reset signal TREST that has been supplied from the timing generator 22 included in the DSD 2 as a timing signal used to control the operation of the signal generation circuit 31R and a signal line 32_12 for transmitting a clock signal TCLK are disposed.

Still furthermore, in the first wiring portion 32, a detection signal line 32_13 for transmitting the drive voltage signals VSIG_1 to VSIG_320 generated by the signal generation circuit 31R to the DSD 2 as detection signals SENS is disposed.

In the second wiring portion 33, a total of 320 signal lines 33_1 to 33_320 used to transmit the x/k-phase (320-phase) drive voltage signals VSIG_1 to VSIG_320 generated by the signal generation circuit 31R to the panel substrate 4R are disposed in parallel with each other.

The signal generation circuit 31R includes a signal processing unit 311 for generating the drive voltage signals VSIG_1 to VSIG_320 from the 10-phase pieces of digital data D_1 to D_10, an output wiring portion 312 including output lines Y_1 to Y_320 used to output the drive voltage signals VSIG_1 to VSIG_320 generated by the signal processing unit 311, a detection line Ys connected to the output lines Y_1 to Y_320 via first switches SW1_1 to SW1_320, second switches SW2_1 to SW2_320 for individually connecting the output lines Y_1 to Y_320 to the signal lines 33_1 to 33_320 included in the second wiring portion 33, and a switching control unit 313 for controlling the first switches SW1_1 to SW1_320 and the second switches SW2_1 to SW2_320.

The signal processing unit 311 generates the 320-phase drive voltage signals VSIG_1 to VSIG_320 from the 10-phase pieces of digital data D_1 to D_10 transmitted from the signal lines 32_1 to 32_10, and outputs the drive voltage signals VSIG_1 to VSIG_320 to the output lines Y_1 to Y_320, respectively. In order to prevent deterioration of a device caused by application of a DC voltage to a liquid crystal of the display panel 41R, the polarity of each of the drive voltage signals VSIG_1 to VSIG_320 with respect to a reference voltage VCOM changes at each period of the driving voltage signal. That is, each of the drive voltage signals VSIG_1 to VSIG_320 is composed of a noninverting signal used to apply a voltage to a positive polarity with respect to the reference voltage VCOM at the first period and an inverting signal used to apply a voltage to a negative polarity with respect to the reference voltage VCOM at the next period.

In the output wiring portion 312, each output line Y_n is bifurcated into two lines that are individually connected to the first switch SW1_*n* and the second switch SW2_*n*.

One end of the detection line Ys is connected to the detection signal line 32_13 disposed in the first wiring portion 32, and the other end thereof is connected to the first switches SW1_1 to SW1_320. That is, the detection line Ys detects the drive voltage signal VSIG_n output from any output line Y_n as the detection signal SENS when any single first switch SW1_*n* is closed, and outputs the detection signal SENS to the detection signal line 32_13.

The second switches SW2_1 to SW2_320 connect the output lines Y_1 to Y_320 to the signal lines 33_1 to 33_320 included in the second wiring portion 33, respectively.

The switching control unit 313 controls the opening and closing of the first switches SW1_1 to SW1_320 and the second switches SW2_1 to SW2_320 in response to the reset signal TREST and the clock signal TCLK supplied from the first wiring portion 32.

Figure 6:
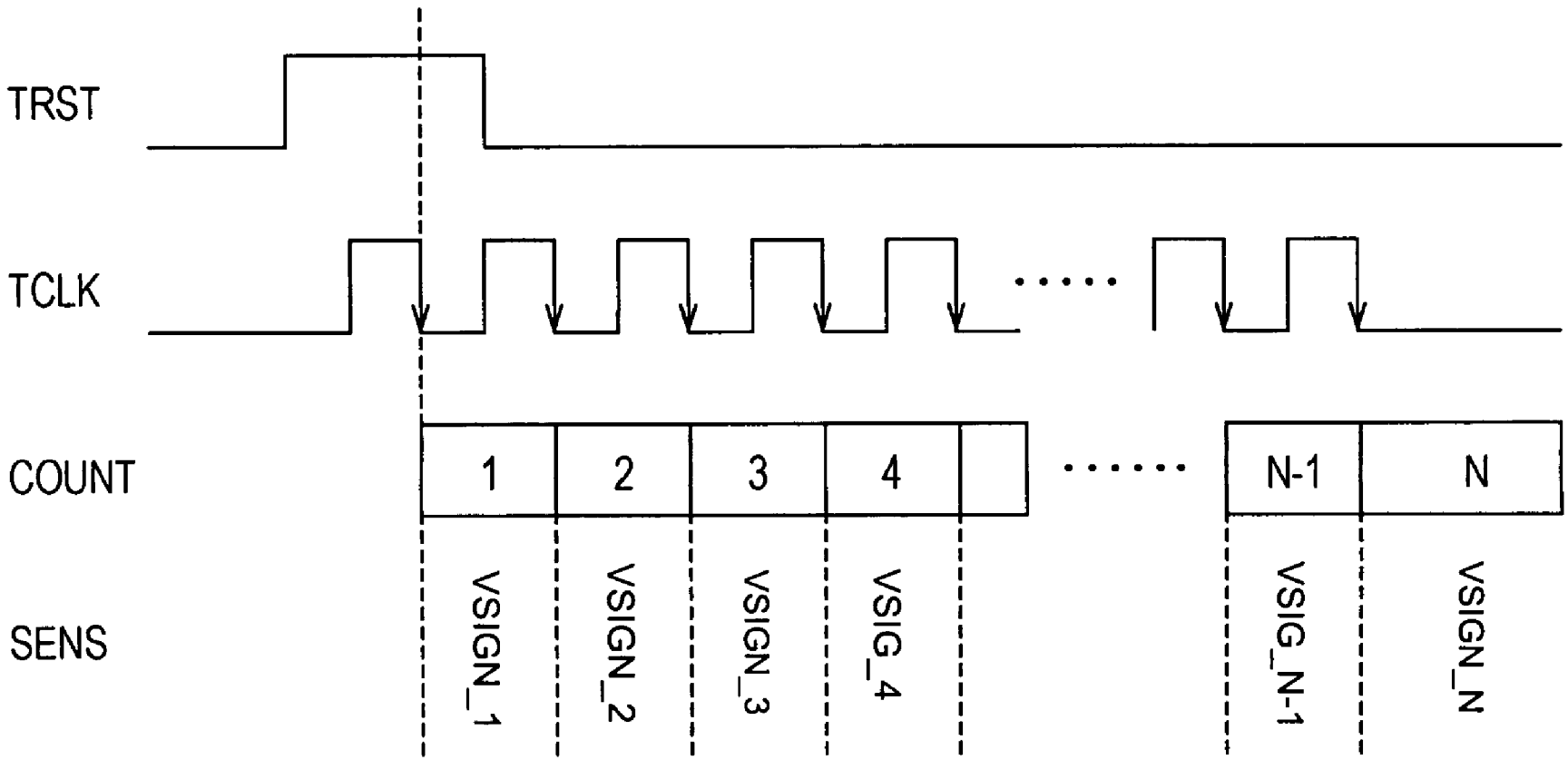
FIG. 6 is a timing chart describing an operation of a switching control unit.

As illustrated in FIG. 6, the switching control unit 313 counts the number of pulses of the clock signal TCLK transmitted in response to the reset signal TREST functioning as a trigger signal, and performs control processing for closing only the first switch SW1_*n* corresponding to the count number among the first switches SW1_1 to SW1_320. For example, if the detection line Ys and the output line Y_n are connected to each other, the switching control unit 313 transmits the clock signal TCLK having n pulses and then stops the supply of the clock signal TCLK so as to close only the first switch SW1_*n*. Consequently, the output line Y_n is connected to the detection line Ys.

The switching control unit 313 can accurately detect the drive voltage signal VSIG_n output from the output line Y_n by opening the second switch SW2_*n* in synchronization with the detection of the drive voltage signal VSIG_n performed by the detection line Ys. The reason for this is that the connection between the output line Y_n and the signal line 33_*n* in the second wiring portion 33 is released by the opening of the second switch SW2_*n* and a signal with no-load characteristic of the display panel 41R can be detected.

The switching control unit 313 performs the above-described operations, thereby enabling the signal generation circuit 31R to transmit the drive voltage signal VSIG_n output from the any output line Y_n as the detection signal SENS to the DSD 2 via the detection line Ys and the detection signal line 32_13 included in the first wiring portion 32.

In the liquid crystal display apparatus 1 provided with the wiring board 3R having the above-described configuration, the detection signal line 32_13 for transmitting the drive voltage signal VSIG_n generated by the signal generation circuit 31R to the DSD 2 as the detection signal SENS is disposed in the first wiring portion 32, and the detection line Ys that has one end connected to the detection signal line 32_13 and the other end connected to the first switch SW1_*n* and outputs the drive voltage signal VSIG_n via the first switch SW1_*n* is disposed in the signal generation circuit 31R. Accordingly, by detecting as the detection signal SENS the drive voltage signal VSIG_n output from the output line Y_n in the signal generation circuit 31R which is connected to the signal line 33_*n* in the second wiring portion 33, the occurrence of an output deviation among the drive voltage signals VSIG_1 to VSIG_320 can be detected.

In order to reduce the output deviation detected as described previously, in the liquid crystal display apparatus 1, the correction section 24 included in the DSD 2 performs the following correction processing on the basis of the detection signal SENS transmitted from the detection signal line 32_13 included in the first wiring portion 32.

In order to focus attention on the output of the drive voltage signal VSIG_n to the detection signal line 32_13 in the first wiring portion 32 as the detection signal SENS, the wiring board 3R illustrated in FIG. 5 detects the single drive voltage signal VSIG_n for convenience of explanation.

On the other hand, pixel data correction processing will be described below in which any two drive voltage signals VSIG_n are simultaneously detected and are then output from the wiring board 3R to the DSD 2 as two detection signals SENS, and pixel data correction is performed on the basis of the result of comparison between the two detection signals SENS.

Figure 7:
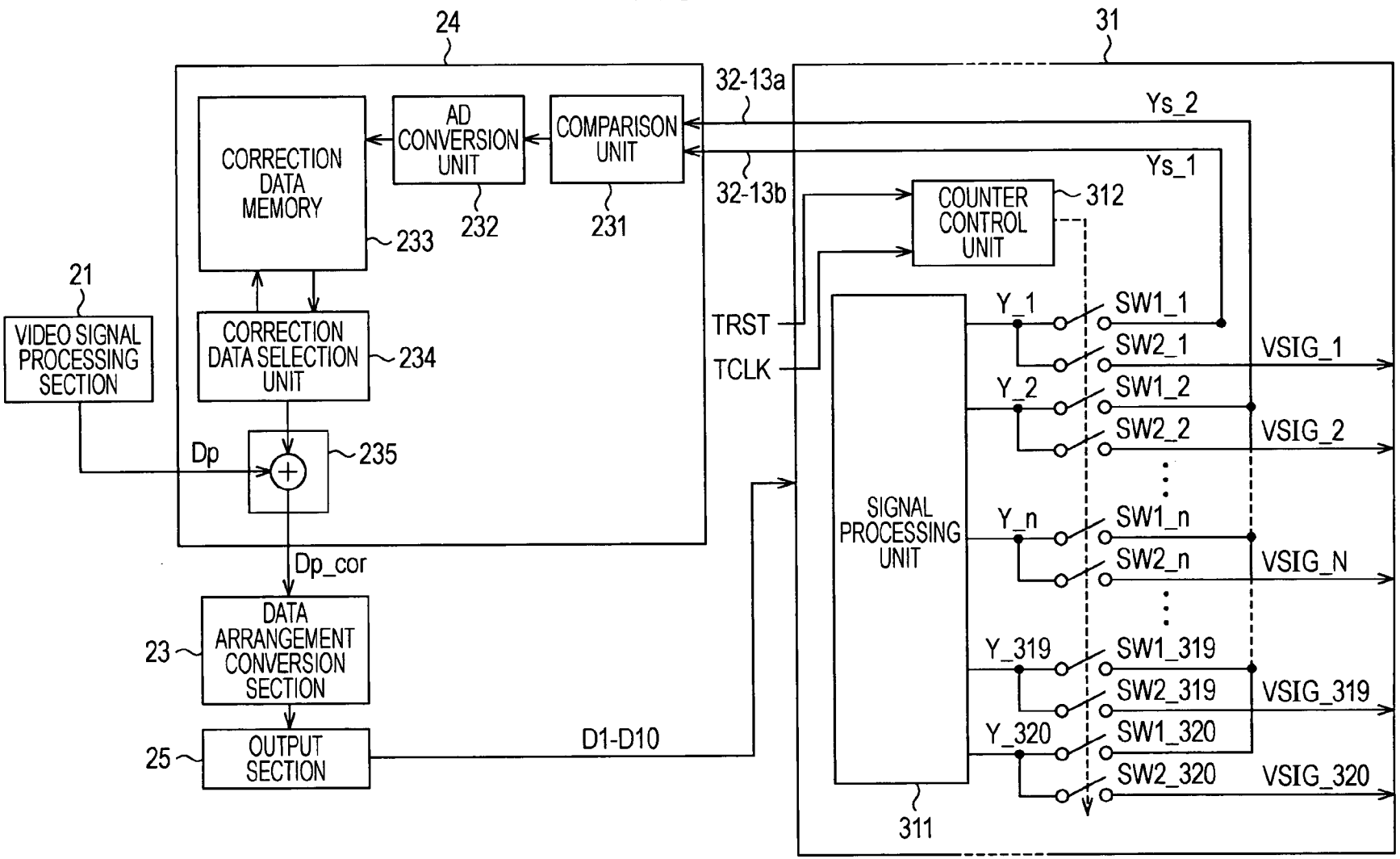
FIG. 7 is a schematic diagram illustrating a configuration of a liquid crystal display apparatus for description of an operation of a correction section.

First, as illustrated in FIG. 7, two detection lines 32_13*a* and 32_13*b* used to simultaneously output two drive voltage signals VSIG_n as detection signals SENS1 and SENS2 are disposed in the first wiring portion 32 at the wiring board 3R. As described preciously, the signal generation circuit 31R includes the signal processing unit 311, the switching control unit 313, the output lines Y_1 to Y_320, the first switches SW1_1 to SW1_320, and the second switches SW2_1 to SW2_320. The electrical connection relationship of these components are the same as that of components included in the signal generation circuit 31R illustrated in FIG. 5, and the description thereof will be therefore omitted.

Unlike the configuration of the signal generation circuit 31R illustrated in FIG. 5, the signal generation circuit 31R includes two detection lines Ys_1 and Ys_2 that are connected to the two detection lines 32_13*b* and 32_13*a* included in the first wiring portion 32, respectively.

The detection line Ys_1 is connected to only the first switch SW1_1 so as to detect, for example, the drive voltage signal VSIG_1 as a specific drive voltage signal functioning as a reference signal. The detection line Ys_2 is connected to the first switches SW1_2 to SW1_320 so as to detect the drive voltage signals VSIG_2 to VSIG_320 excluding the drive voltage signals VSIG_1 as a drive voltage signal to be compared, and is connected to the output line Y_n when only the first switch SW1_*n* is closed by the opening and closing control processing performed by the switching control unit 313.

That is, at the wiring board 3R, the drive voltage signals VSIG_1 is always output as the detection signal SENS1, and the drive voltage signal VSIG_n excluding the drive voltage signals VSIG_1 is output as the detection signal SENS2.

The correction section 24 to which the two detection signals SENS1 and SENS2 are simultaneously supplied performs the following processing so as to make an output signal level of each of the drive voltage signals VSIG_2 to VSIG_320 conform to that of the drive voltage signal VSIG_1 output from the signal processing unit 311.

That is, the correction section 24 includes a comparison unit 231 for comparing the detection signals SENS1 and SENS2 with each other, an AD conversion unit 232 for converting the difference between the signal levels of the detection signals SENS1 and SENS2, which have been compared with each other by the comparison unit 231, into digitalized comparison data, a correction data memory 233 for storing the comparison data converted by the AD conversion unit 232 as correction data, a correction data selection unit 234 for selecting correction data corresponding to pixel data to be corrected from among pieces of correction data stored in the correction data memory 233, and a correction data selection unit 234 for selecting correction data corresponding to pixel data to be corrected from among pieces of correction data stored in the correction data memory 233, and an adding unit 235 for adding the correction data selected by the correction data selection unit 234 to the pixel data to be corrected.

The comparison unit 231 detects the difference of the signal levels of the detection signals SENS1 and SENS2 as a comparison signal, and supplies the comparison signal to the AD conversion unit 232.

The AD conversion unit 232 converts the comparison signal supplied from the comparison unit 231 into digitalized comparison data, and supplies the comparison data to the correction data memory 233.

Figure 8A:
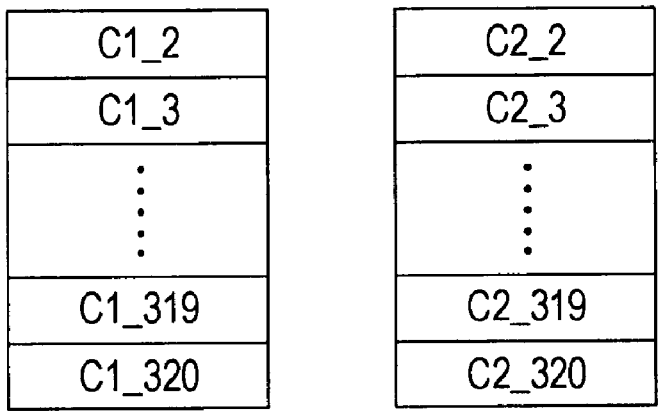
FIGS. 8A and 8B are diagrams describing data stored in a correction data memory.
Figure 8B:
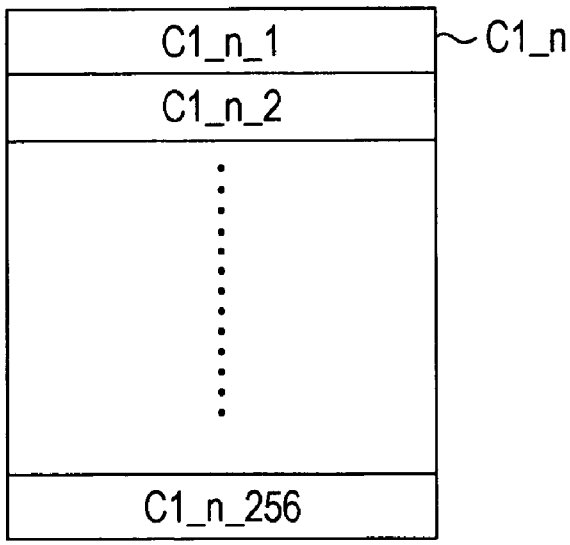

For example, as illustrated in FIG. 8A, the correction data memory 233 stores pieces of noninverting signal correction data C1_2 to C1_320 used to correct noninverting signals of the drive voltage signals VSIG_2 to VSIG_320 and pieces of inverting signal correction data C2_2 to C2_320 used to correct inverting signals of the drive voltage signals VSIG_2 to VSIG_320. As illustrated in FIG. 8B, noninverting signal correction data C1_*n* used to correct a noninverting signal of the drive voltage signal VSIG_n is composed of pieces of noninverting signal correction data C1_*n*_1 to C1_*n*_256 corresponding to 256 gradation levels. The inverting signal correction data C2_*n* is similarly composed of pieces of inverting signal correction data C2_*n*_1 to C2_*n*_256 corresponding to a plurality of gradation levels.

For example, as pieces of correction data stored in the correction data memory 233, pieces of noninverting signal correction data C1_2_126 to C1_319_126 used to correct noninverting signals of 126 gradation levels are obtained in the following manner.

That is, the liquid crystal display apparatus 1 externally receives a digital video signal in which all pixels included in one frame are of 126 gradation levels, and causes the signal generation circuit 31R to generate the drive voltage signals VSIG_1 to VSIG_320 that are continuous noninverting signals in response to the digital video signal. Here, the signal generation circuit 31R on the wiring board 3R generates DC voltage signals. However, by opening all of the second switches SW2_1 to SW2_320 at the time of detection processing, the application of a DC voltage to a liquid crystal in the display panel 41R can be prevented.

The correction section 24 compares the drive voltage signal VSIG_1 with each of the drive voltage signals VSIG_2 to VSIG_320 using the detection signals SENS1 and SENS2, thereby obtaining the pieces of noninverting signal correction data C1_2_126 to C1_319_126 used to correct the noninverting signals of 126 gradation levels.

The correction data selection unit 234 selects correction data corresponding to the gradation level of pixel data to be corrected from among pieces of correction data in the correction data memory 233 and reads the selected correction data from the correction data memory 233. For example, if the gradation level L of target pixel data to be corrected is between gradation levels 128 and 129 and the target pixel data is output from the signal generation circuit 31R as the drive voltage signal VSIG_160 that is a noninverting signal, the correction data selection unit 234 reads the pieces of noninverting signal correction data C1_160_128 and C1_160_129 as pieces of correction data for noninverting signals.

The adding unit 235 adds the correction data read by the correction data selection unit 234 to the pixel data to be corrected. As described previously, if the gradation level L of the target pixel data to be corrected is between gradation levels 128 and 129 and the target pixel data is output from the signal generation circuit 31R as the drive voltage signal VSIG_160, the adding unit 235 adds a correction value CORR1 obtained by the following equation (1) to the noninverting signal of the target pixel data.

$$\mathrm{CORR1}=(L-128)\times(C1_160_128)+(129-L)\times(C1_160_129) \quad \text{Equation (1)}$$

Thus, in the correction section 24, the difference between the drive voltage signal VSIG_1 and each of the drive voltage signals VSIG_2 to VSIG_320 is stored as correction data in the correction data memory 233 in advance. Using the correction data stored in the correction data memory 233, pixel data is corrected. Using the corrected pixel data, the signal generation circuit 31R can generate the drive voltage signals VSIG_1 to VSIG_320 whose signal level is made conform to that of the drive voltage signal VSIG_1, thereby reducing an output deviation among the drive voltage signals VSIG_1 to VSIG_320.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus including a panel substrate on which a display panel and signal line selecting means are disposed, the display panel having x×y pixels arranged in a matrix at intersections of x (x is a natural number) signal lines disposed in a column direction and y (y is a natural number) gate lines disposed in a row direction, the signal line selecting means sequentially selecting k signal lines included in each of x/k signal line groups obtained by dividing the x signal lines into the x/k signal line groups each including the k signal lines that are adjacent to each other without overlapping each other so that the sequential selection of the k signal lines is simultaneously performed in the x/k signal line groups and supplying drive voltage signals to a total of x/k selected signal lines, the display apparatus comprising:

input means for receiving a digital video signal composed of pixel data arranged in a predetermined scanning direction;

a digital signal processing section including data arrangement converting means for converting the digital video signal received by the input means into a total of x/k pixel data strings, and output means for outputting digital video signals corresponding to the pixel data strings converted by the data arrangement converting means as a total of p-phase pieces of digital data; and a wiring board including a first wiring portion in which p signal lines used to transmit a digital video signal composed of the p-phase pieces of digital data output from the digital signal processing section are disposed in parallel with each other, a signal generation circuit for generating x/k-phase drive voltage signals from the digital video signal transmitted from the first wiring portion, and a second wiring portion in which x/k signal lines used to transmit the x/k-phase drive voltage signals generated by the signal generation circuit to the signal line selecting means disposed on the display panel are disposed in parallel with each other, wherein the first wiring portion in the wiring board includes a detection signal line used to transmit the drive voltage signals generated by the signal generation circuit to the digital signal processing section, wherein the signal generation circuit includes an output wiring portion in which x/k output lines used to individually transmit the drive voltage signals to the signal lines disposed in the second wiring portion are disposed in parallel with each other, and a detection line having one end connected to the detection signal line disposed in the first wiring portion and the other end connected to the output lines in the output wiring portion via switches, and wherein the output lines are individually provided with the switches used to individually connect or disconnect the output lines to or from the signal lines disposed in the second wiring portion and further wherein the detection line is composed of a first detection line and a second detection line which are individually connected to two output lines optionally selected from among the x/k output lines disposed in the output wiring portion, wherein the detection signal line is composed of a first detection signal line connected to the first detection line and a second detection signal line connected to the second detection line, and wherein the digital signal processing section includes comparing means for comparing the drive voltage signal transmitted from the first detection signal line and the drive voltage signal transmitted from the second detection signal line with each other, and correcting means for correcting each of the pieces of pixel data included in each of the data strings converted by the data arrangement converting means on the basis of a result of comparison performed by the comparing means.

2. A display apparatus including a panel substrate on which a display panel and a signal line selection unit are disposed, the display panel having x×y pixels arranged in a matrix at intersections of x (x is a natural number) signal lines disposed in a column direction and y (y is a natural number) gate lines disposed in a row direction, the signal line selection unit sequentially selecting k signal lines included in each of x/k signal line groups obtained by dividing the x signal lines into the x/k signal line groups each including the k signal lines that are adjacent to each other without overlapping each other so that the sequential selection of the k signal lines is simultaneously performed in the x/k signal line groups and supplying drive voltage signals to a total of x/k selected signal lines, the display apparatus comprising:

an input unit configured to receive a digital video signal composed of pieces of pixel data arranged in a predetermined scanning direction;

a digital signal processing section including a data arrangement conversion unit configured to convert the digital video signal received by the input unit into a total of x/k pixel data strings, and an output unit configured to output digital video signals corresponding to the pixel data strings; and a wiring board including a first wiring portion in which p signal lines used to transmit a digital video signal composed of the p-phase pieces of digital data output from the digital signal processing section are disposed in parallel with each other, a signal generation circuit for generating x/k-phase drive voltage signals from the digital video signal transmitted from the first wiring portion, and a second wiring portion in which x/k signal lines used to transmit the x/k-phase drive voltage signals generated by the signal generation circuit to the signal line selection unit disposed on the display panel are disposed in parallel with each other and wherein a detection line having one end connected to the detection signal line disposed in the first wiring portion and the other end connected to the output lines in the output wiring portion via switches, and wherein the output lines are individually provided with the switches used to individually connect or disconnect the output lines to or from the signal lines disposed in the second wiring portion and further wherein the detection line is composed of a first detection line and a second detection line which are individually connected to two output lines optionally selected from among the x/k output lines disposed in the output wiring portion, wherein the detection signal line is composed of a first detection signal line connected to the first detection line and a second detection signal line connected to the second detection line, and wherein the digital signal processing section includes comparing means for comparing the drive voltage signal transmitted from the first detection signal line and the drive voltage signal transmitted from the second detection signal line with each other, and correcting means for correcting each of the pieces of pixel data included in each of the data strings converted by the data arrangement converting means on the basis of a result of comparison performed by the comparing means.

* * * * *